US008326607B2

(12) United States Patent
Nyström

(10) Patent No.: US 8,326,607 B2
(45) Date of Patent: Dec. 4, 2012

(54) METHOD AND ARRANGEMENT FOR ENHANCING SPEECH QUALITY

(75) Inventor: Martin Nyström, Hörja (SE)

(73) Assignee: Sony Ericsson Mobile Communications AB, Lund (SE)

( * ) Notice: Subject to any disclaimer, the term of this patent is extended or adjusted under 35 U.S.C. 154(b) by 386 days.

(21) Appl. No.: 12/685,534

(22) Filed: Jan. 11, 2010

(65) Prior Publication Data

US 2011/0172998 A1 Jul. 14, 2011

(51) Int. Cl.
*G10L 11/00* (2006.01)

(52) U.S. Cl. ..... 704/201; 704/200; 704/500; 704/501

(58) Field of Classification Search ..... 704/200–201, 704/500–502
See application file for complete search history.

(56) References Cited

U.S. PATENT DOCUMENTS

| | | | | |
|---|---|---|---|---|
| 5,327,521 | A * | 7/1994 | Savic et al. | 704/272 |
| 7,552,048 | B2 * | 6/2009 | Xu et al. | 704/206 |
| 7,698,143 | B2 * | 4/2010 | Ramakrishnan et al. | 704/500 |
| 8,078,474 | B2 * | 12/2011 | Vos et al. | 704/500 |
| 8,112,284 | B2 * | 2/2012 | Kjorling et al. | 704/500 |
| 8,121,847 | B2 * | 2/2012 | Klinke et al. | 704/500 |
| 2001/0044712 | A1 * | 11/2001 | Vainio et al. | 704/201 |
| 2002/0095296 | A1 * | 7/2002 | Hind et al. | 704/500 |
| 2006/0265210 | A1 * | 11/2006 | Ramakrishnan et al. | 704/205 |
| 2006/0282263 | A1 * | 12/2006 | Vos et al. | 704/223 |
| 2009/0313027 | A1 * | 12/2009 | Tabus et al. | 704/500 |
| 2010/0280831 | A1 * | 11/2010 | Salami et al. | 704/500 |

OTHER PUBLICATIONS

Notification of Transmittal of the International Search Report and the Written Opinion of the International Searching Authority, or the Declaration corresponding to PCT/EP2010/067314, mailed Mar. 2, 2011, 13 pages.

Hiroshi Yasukawa, "Implementation of Frequency Domain Digital Filter for Speech Enhancement", Proceedings of the Third IEEE International Conference on Rodos, Oct. 13-16, 1996, pp. 518-521, XP010217050.

Venkatesh Krishman et al., "EVRC-Wideband: The New 3GPP2 Wideband Vocoder Standard", IEEE International Conference on Acoustics, Speech, and Signal Processing, Apr. 15-20, 2007, pp. II-333-II-336, XP031463184.

Jean-Marc Valin et al., "Bandwidth Extension of Narrowband Speech for Low Bit-Rate Wideband Coding", University of Sherbrooke, Department of Electrical Engineering, Sep. 17, 2000, pp. 130-132, XP010520065.

* cited by examiner

*Primary Examiner* — Douglas Godbold
(74) *Attorney, Agent, or Firm* — Harrity & Harrity, LLP

(57) ABSTRACT

The present invention relates to a method and arrangement for improving quality of a voice transmission by extracting filter coefficient parameters with respect to a voice signal in a first speech transmission rate, and using the extracted filter coefficient parameters in a second transmission rate that is equal or lower than the first transmission rate.

10 Claims, 6 Drawing Sheets

METHOD AND ARRANGEMENT FOR ENHANCING SPEECH QUALITY

TECHNICAL FIELD

The present invention relates to method and device for enhancing speech properties in a mobile device.

BACKGROUND

Adaptive Multirate Wide Band (AMR-WB) is a speech-compression algorithm that offers substantially superior voice quality (even in noisy environment) because of doubled throughput, without extra radio and transmission bandwidth requirements.

It is standardized in 3GPP Rel-5 and applicable in 3GPP mobile circuit switched systems (e.g., GSM, WCDMA), as well as packet switched systems (e.g., IMS Telephony, VoIP).

AMR-WB has nine coding rates, including the first three rates 6.60, 8.85, and 12.65 kbps, which constitute the mandatory multi-rate configuration.

The ongoing evolution of wireless communication systems and mobile phones has given rise to a variety of compelling mobile applications (e.g., music player, camera, game console) and services (e.g., mobile internet, mobile TV, etc.). Likewise, many services have evolved significantly in order to satisfy user demands. In contrast, from a user perspective, voice telephony has not changed noticeably since mobile telephony was still very new. Notwithstanding, voice service has continued to evolve. Significant milestones include the introduction of the enhanced full-rate codec (EFR) and, later, the Adaptive Multirate (AMR) voice codec, which increased voice quality and boosted channel error robustness and capacity. The narrowband AMR (AMR-NB) codec, which supports the bandwidth of traditional telephony, is now widely deployed in GSM/EDGE and UMTS systems. It is also the codec of choice for the forthcoming multimedia telephony service for IMS (MTSI) standard from 3GPP.

The new wideband AMR (AMR-WB) codec, whose voice frequency band is twice that of AMR-NB, enables telephony services with true, natural voice quality, clearly outperforming other existing mass-market telephony services, including those used for wire-line telephony.

However, a phenomenon exists when, for instance, a caller changes between cells. When an AMR-WB call is transferred into an AMR-NB call, an audible degradation in voice sound quality results.

The principle for bandwidth extension presently used is illustrated in FIG. 1. An incoming AMR NB call 5 to the device is processed to generate a high frequency element in a non-linear element 6 and then filtered using a multi-tap FIR (Finite Impulse Response) filter 7 for overtone shaping, which is added 8 to the incoming AMR-NB call to produce a call with fixed bandwidth and bandwidth extension. The result 9 is a call with extension added fixed bandwidth.

SUMMARY

Embodiments of the present invention the above-mentioned audio degeneration.

Existing technologies for bandwidth extension use a fixed set of filter parameters to extend bandwidth. The proposed method of the invention utilizes the ongoing call to extract optimum filter parameters.

One advantage of the proposed method gives, amongst others, a superior, more natural optimized bandwidth extension for the callers involved, and hence a less perceived degradation when a call is transferred from AMR WB to AMR NB.

Caller optimized bandwidth extension filters according to the present invention are of superior audible quality than standard filters with fixed parameters, and may be optimized to fit every voice fair.

At least for these reasons, a method of improving quality of a voice transmission, the method includes extracting filter coefficient parameters with respect to a voice signal in a first speech transmission rate, and using the extracted filter coefficient parameters in a second transmission rate, the second transmission rate being equal or lower than the first transmission rate. The first transmission rate uses Adaptive Multirate Wide Band (AMR-WB) or Adaptive Multirate Full Rate (AMR-FR). The second transmission rate uses Adaptive Multirate Narrow Band (AMR-NB) or Adaptive Multirate Half Rate (AMR-HR).

The method may further comprise steps of filtering the transmission in the first transmission rate filtered and extracting a signal in the second transmission rate, providing the extracted signal in the second transmission rate to a nonlinear element for bandwidth extension, providing and original transmission and output from the filter to a comparator, providing output of the comparator, which is a difference between the original transmission signal and output of the filter with added bandwidth extension to a LMS calculator, providing output of the LMS calculator to a filter coefficient adapter, in which the coefficients in the bandwidth extension filter is adapted to optimize the LMS value, and providing the output from the filter coefficient adapter to the filter. The filter may be a FIR filter.

In one embodiment filter coefficients may be stored for different voices with respect to incoming unique identity and/or voice recognition when available first transmission rate available.

The invention also relates to an arrangement for enhancing quality of a voice transmission in a communication device, the arrangement including a first portion for extracting filter coefficient parameters with respect to a speech signal in a first transmission rate, and a second portion for using the extracted filter coefficient parameters as a reference value in a second transmission rate, the second transmission rate being equal or lower than the first transmission rate. The arrangement may comprise a fixed filter, a nonlinear element, a Multi-tap FIR filter, a FIR filter coefficient adapter, a comparator and an arrangement for optimizing filter coefficients to minimize differences between original and created signals.

The invention also relates to a mobile communication device including a housing, a display, a keypad, a microphone, an ear-piece, an antenna, a radio interface circuitry, a codec circuitry, and a controller and a memory, wherein the controller is configured to extract filter coefficient parameters with respect to a voice signal in a first transmission rate, and use the extracted filter coefficient parameters as a reference value in a second transmission rate, the second transmission rate being equal or lower than the first transmission rate.

The invention also relates to a computer program including program code means for improving quality of a voice transmission when run on a computer. The computer program includes code for extracting filter coefficient parameters with respect to a voice signal in a first speech transmission rate, and a code for using the extracted filter coefficient parameters in a second transmission rate, the second transmission rate being equal or lower than the first transmission rate.

The invention also relates to a computer product including program code means stored on a computer readable medium, when the program product is run on a computer, for performing improvement of quality of a voice transmission when run on a computer. The computer program includes code for extracting filter coefficient parameters with respect to a voice signal in a first speech transmission rate, and a code for using the extracted filter coefficient parameters in a second transmission rate, the second transmission rate being equal or lower than the first transmission rate.

BRIEF DESCRIPTION OF THE DRAWINGS

The invention is described in a non-limiting way with respect to a number of exemplary embodiments, in which.

DETAILED DESCRIPTION

Figure 1:
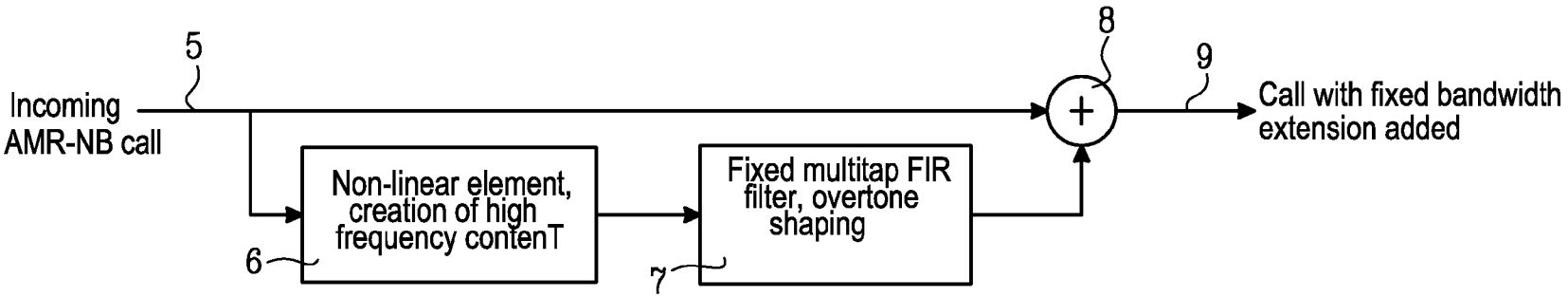
(PRIOR ART) Fig. 1
FIG. 1 is a diagram of principle for bandwidth extension according to convention.
Figure 2:
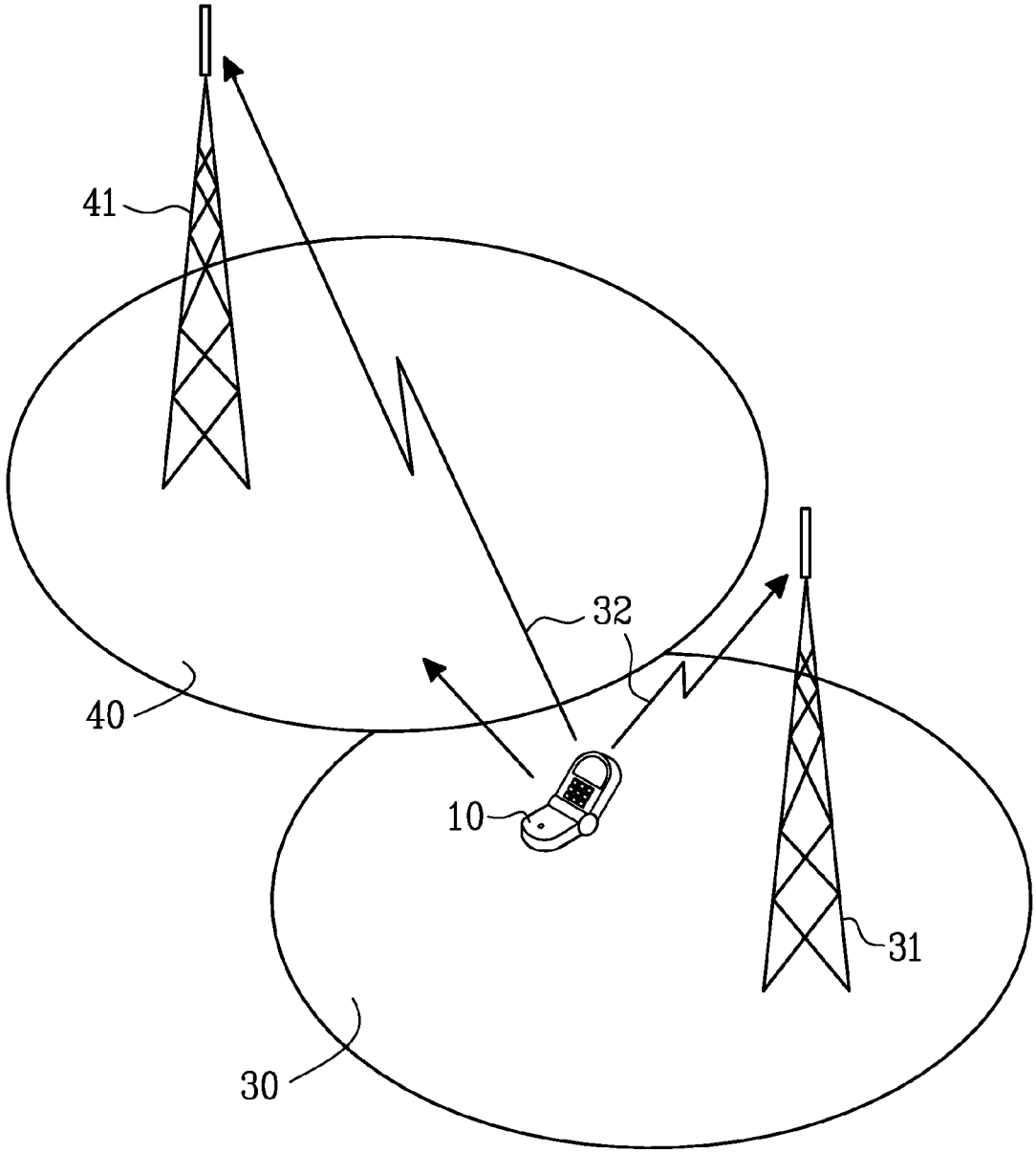
FIG. 2 is a schematic view of a communication network implementing a device according to the present invention.

FIG. 2 illustrates one example of an application of the present invention. A mobile device 10, such as a cell phone, used by a caller moves within a first cell 30 within coverage of a base station 31 towards a second cell 40 within coverage of a base station 41. A voice transmission 32 uses AMR WB and when the caller changes between cells 30 and 40 and, thus, between base stations 31 and 41, the AMR WB call may be transferred into an AMR NB call, e.g., due to signal strength, handover procedure, etc., and an audible degradation in voice sound quality may be experienced as the sound quality associated with AMR WB may be selectively superior to the sound quality associated with AMR NB.

According to one embodiment of the present invention, bandwidth extension filtering techniques are used to diminish the degree of degradation experienced.

During an ongoing call on high quality (AMR WB/FR), it is possible to adjust filtering properties towards an ongoing reference, to create filters (maximally) adapted to the particular callers.

Figure 3:
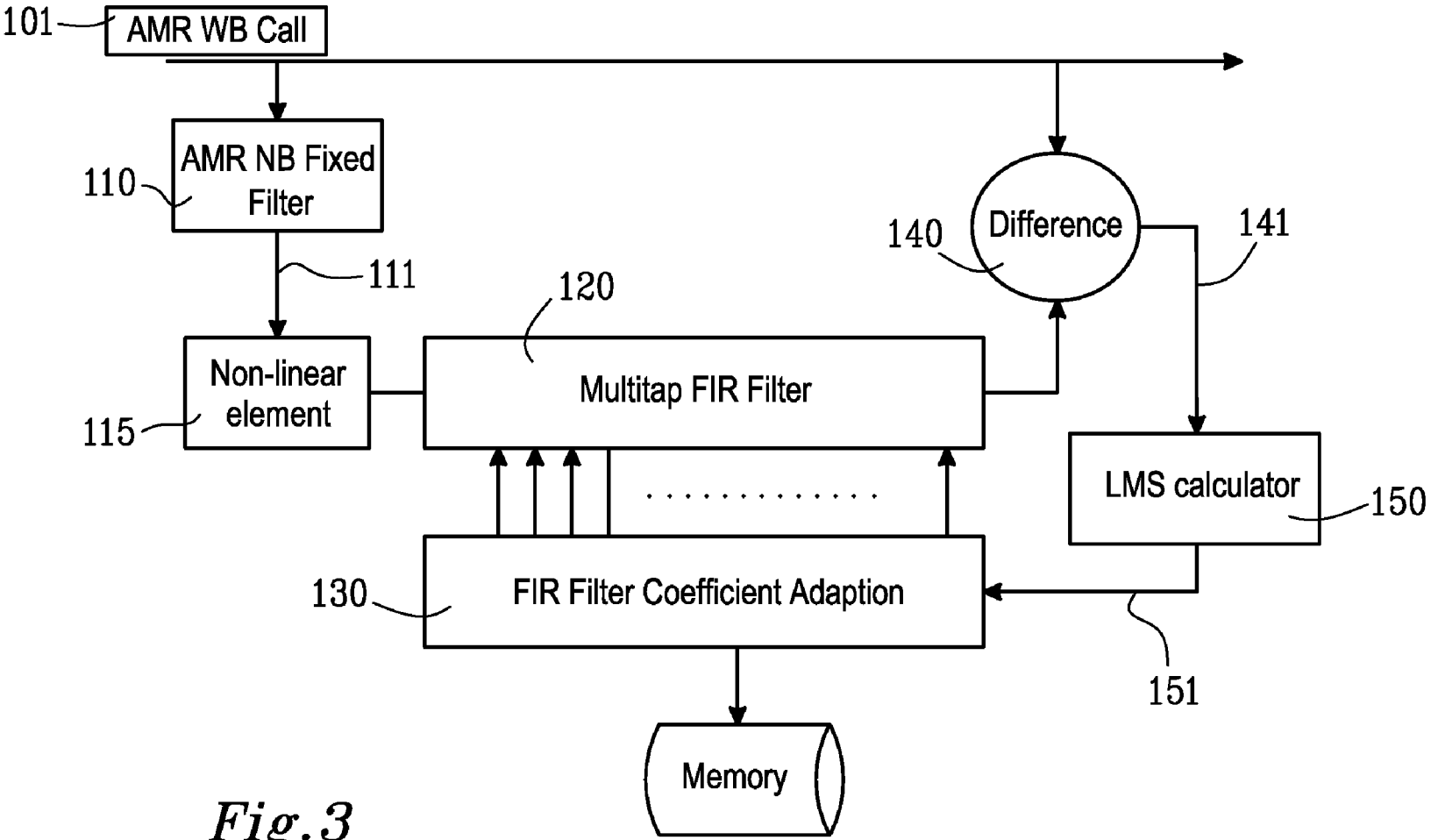
FIG. 3 is a schematic diagram of an arrangement for bandwidth extension according to present invention.

FIG. 3 illustrates schematically one exemplary embodiment of an adaptive bandwidth extension optimization arrangement according an embodiment of the present invention, when a reference call is available.

An arrangement 100 includes AMR NB fixed filter 110, a non-linear element 115, a Multi-tap FIR filter 120, FIR filter coefficient adapter 130, a comparator 140, and a Least Means Squared (LMS) calculator 150. As LMS algorithms are used in adaptive filters to find the filter coefficients that relate to producing the least mean squares of the error signal, difference between the desired and the actual signal, other types of filter/calculators may be used, for example, but not exclusively, Normalized least mean squares (NLMS) filter, Recursive least squares (RLS) filter, Wiener filter, Multi-delay block frequency domain adaptive filter (MDF). The ongoing AMR WB call signal 101 in the device may be filtered in AMR NB fixed filter 110, such that an AMR NB call signal is extracted and provided to nonlinear element 115, which creates a signal with high frequency and wideband content out of the low frequency (narrowband) input signal and bandwidth extraction. The result may be provided to Multi-tap FIR filter 120 for tuning FIR filter 120 may fine tune the extended frequency content to sound as natural as possible. Thus, filter coefficients may be optimized to minimize differences between original and created signals.

The output of FIR filter 120 may be provided to a comparator 140, which may compare the fine-tuned output from FIR filter 120 to original AMR-WB call signal 101.

An output 141 of comparator 140, which may represent the difference between original AMR-WB call signal 101 and the AMR-NB with added bandwidth extension from FIR filter 120 may be compared in LMS calculator 150, e.g., using an LMS algorithm or other algorithm.

An output 151 of LMS calculator 150 may be provided to FIR filter coefficient adapter 130, in which the coefficients in the bandwidth extension FIR filter 120 may be adapted to optimize the LMS value. Output 151, FIR filter coefficients, from FIR filter coefficient adapter 130 may be provided to FIR filter 120.

The parameters may be compared (e.g., in LMS calculator 150) and parameters resulting optimal values may be stored.

FIR filter 120 may be designed using one or more of, for example: Parks-McClellan, Windowing, or Direct Calculation. Of course, other methods suitable for the invention may be used. Other filters with same functionality may be used to substitute FIR filter 120.

Thus, the invention suggests, extracting filter parameters for the received voice call during an AMR WB (high quality) call which may be assumed to exhibit superior quality. These may then be stored during the call session and used for bandwidth extension when the call is routed over to a channel with a lower bandwidth (AMR NB).

Thus, a "default filter" can be used when, for example, a user puts a call for the first time in an AMR NB connection and there are no "out-filtered" optimized filter coefficients.

According to one embodiment of the invention, the filter coefficients may be stored for different callers, for example, with respect to incoming phone number and/or voice recognition or any other unique identity, etc., to be used for AMR NB calls when available.

Figure 4:
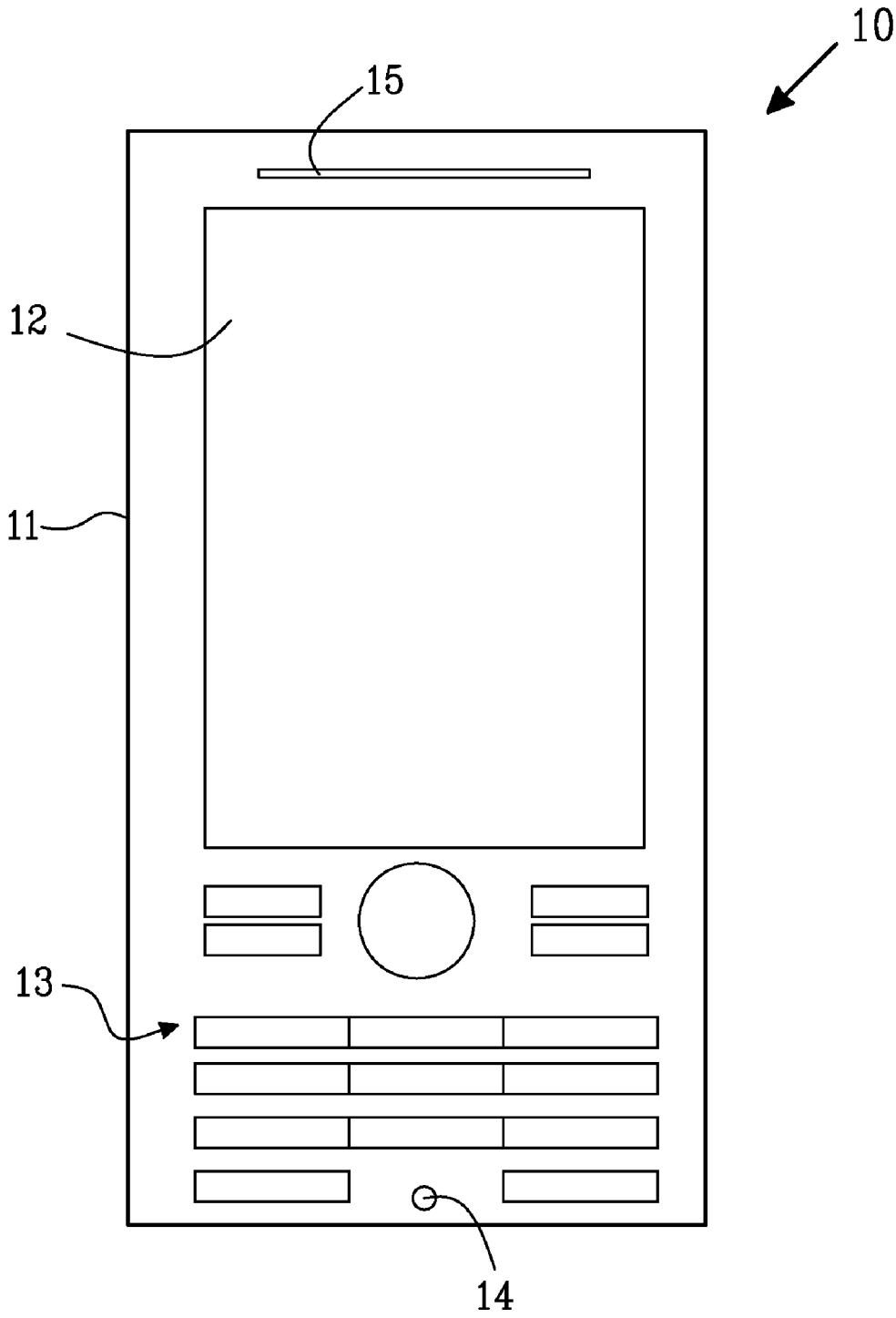
FIG. 4 is a schematic view of an electronic device that can be used in conjunction with the implementation of various embodiments of the present invention.
Figure 5:
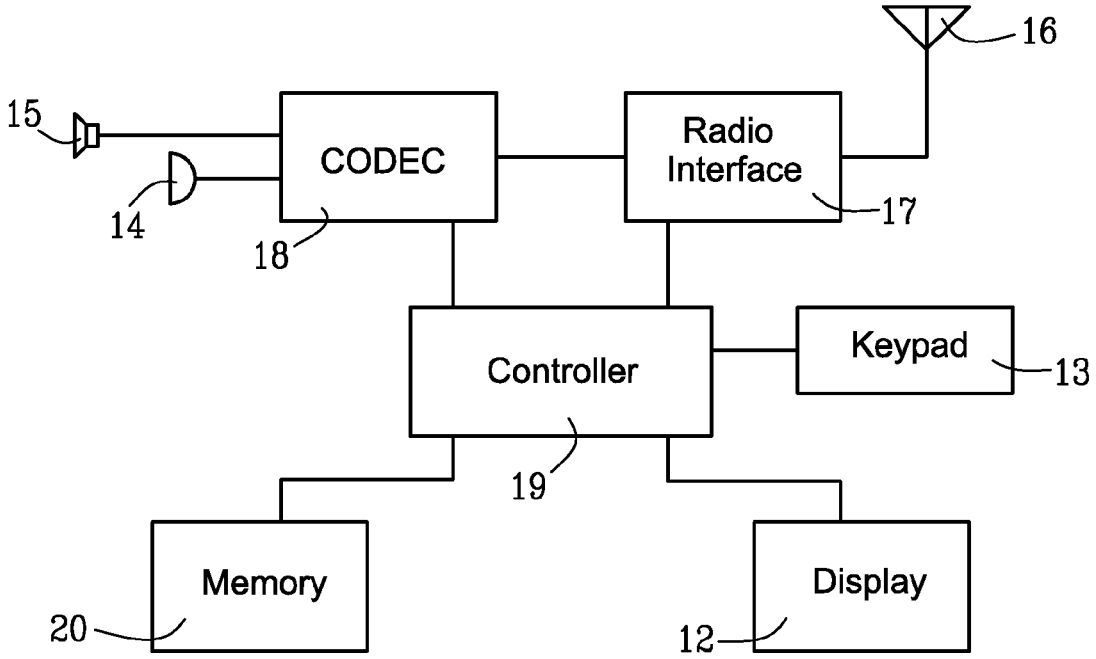
FIG. 5 is a schematic representation of the circuitry which may be included in the electronic device of FIG. 4.

FIGS. 4 and 5 show one representative mobile device 10 within which the present invention may be implemented. It should be understood, however, that the present invention is not intended to be limited to any particular type of electronic device. Mobile device 10 of FIGS. 3 and 4 includes a housing 11, a display 12, for example, in the form of a liquid crystal display (LCD), a keypad 13, a microphone 14, an ear-piece 15, an antenna 16, radio interface circuitry 17, codec circuitry 18, a controller 19, and a memory 20. Individual circuits and elements are all of a type well known in the art, for example in the Sony Ericsson Mobile Communications portfolio of mobile telephones.

Figure 6:
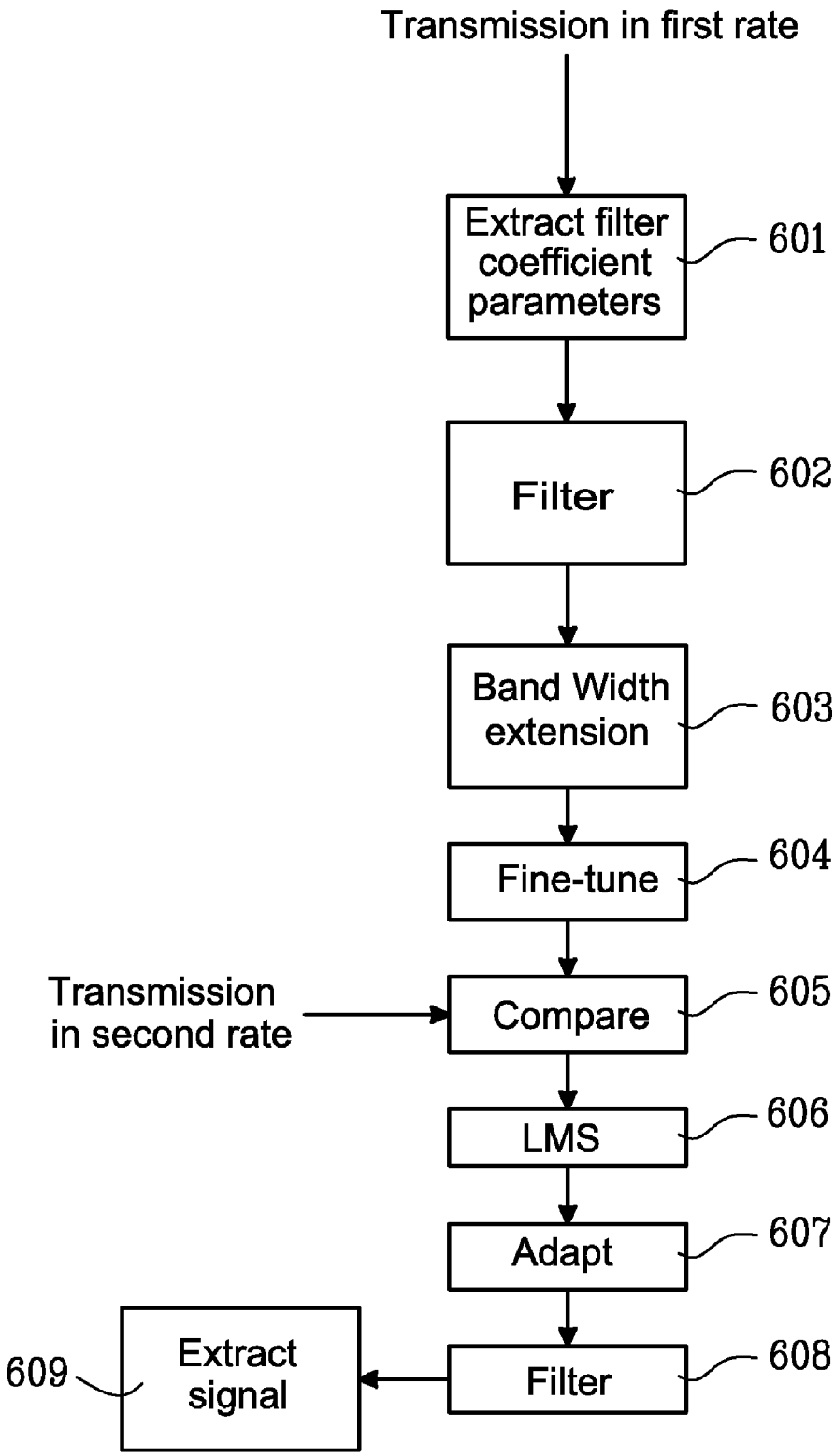
FIG. 6 is a schematic flow diagram illustrating several steps of the method of the invention.

In sum, and as an general example of the present invention, as illustrated in flow diagram of FIG. 6, a method of improving quality of voice transmission may include extracting filter coefficient parameters (601) with respect to a voice signal in a first speech transmission rate, using (609) the extracted filter coefficient parameters in a second transmission rate, filtering (602) the transmission in the first transmission rate and extracting a signal in the second transmission rate, providing the extracted signal in the second transmission rate to a non-linear element for bandwidth extension (603), fine-tuning (604) output from the non-linear element in a filter, providing the original transmission and output from said filter to a comparator and comparing (605), providing output of the comparator, which is a difference between the original transmission signal and output of said filter with added bandwidth extension to an LMS calculator (606), providing the output of the LMS calculator to a filter coefficient adapter, in which the coefficients in the bandwidth extension filter is adapted (607) to optimize the LMS value, and providing the output from the filter coefficient adapter to the filter (608).

The invention may be implemented in the controller and Codec parts of the device.

The invention may be implemented in systems using AMR FR (Full Rate) and AMR HR (Half Rate).

The various embodiments of the present invention described herein are described in the general context of method steps or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, read only memory (ROM), random access memory (RAM), compact discs (CDs), digital versatile discs (DVD), etc. Generally, program modules may include routines, programs, objects, components, data structures, etc., that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Software and web implementations of various embodiments of the present invention can be accomplished with standard programming techniques with rule-based logic and other logic to accomplish various database searching steps or processes, correlation steps or processes, comparison steps or processes and decision steps or processes. It should be noted that the words "component" and "module," as used herein and in the following claims, is intended to encompass implementations using one or more lines of software code, and/or hardware implementations, and/or equipment for receiving manual inputs.

The foregoing description of embodiments of the present invention, have been presented for purposes of illustration and description. The foregoing description is not intended to be exhaustive or to limit embodiments of the present invention to the precise form disclosed, and modifications and variations are possible in light of the above teachings or may be acquired from practice of various embodiments of the present invention. The embodiments discussed herein were chosen and described in order to explain the principles and the nature of various embodiments of the present invention and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. A method of improving quality of a voice transmission, the method comprising:

communicating, by a mobile device and via a first base station, a first voice signal using a wide band speech-compression algorithm;

filtering the first voice signal to extract filter coefficient parameters, filtering the first voice signal including:

filtering, in a first filter, the first voice signal at a first transmission rate and extracting a signal at a second transmission rate that is lower than the first transmission rate, providing the extracted signal to a non-linear element for bandwidth extension, tuning an output from the non-linear element in a second filter, providing the first voice signal and an output from the second filter to a comparator, the output of the second filter including a bandwidth extension, providing an output of the comparator, which is a difference between the first voice signal and the output of the second filter including the bandwidth extension, to a least means squared (LMS) calculator, providing an output of the LMS calculator to a filter coefficient adapter, in which coefficients in the second filter are adapted to optimize an LMS value, and providing an output from the filter coefficient adapter to the second filter; and using, by the mobile device, the extracted filter coefficient parameters to communicate, via a second base station, a second voice signal using a narrow band speech-compression algorithm.

2. The method of claim 1, where the wide band speech-compression algorithm comprises Adaptive Multirate Wide Band (AMR-WB) or Adaptive Multirate Full Rate (AMR-FR).

3. The method of claim 1, where the narrow band speech-compression algorithm comprises Adaptive Multirate Narrow Band (AMR-NB) or Adaptive Multirate Half Rate (AMR-HR).

4. The method of claim 1, further comprising:

storing the filter coefficients in association with a user associated with the first voice signal, the filter coefficients to be used for transmitting subsequent voice signals associated with the user when the first transmission rate is determined to be available for transmission of the subsequent voice signals.

5. The method of claim 1, where the second filter is a filter impulse response (FIR) filter.

6. An arrangement for enhancing quality of a voice transmission in a communication device, the arrangement comprising:

a first portion to:

communicate, via a first base station, a first voice signal using a wide band speech-compression algorithm, and filter the first voice signal to extract filter coefficient parameters with respect to a speech signal in a first transmission rate, when, filtering the first voice signal, the first portion being to:

filter, in a first filter, the first voice signal at a first transmission rate and extract a signal at a second transmission rate that is lower than the first transmission rate, provide the extracted signal to a non-linear element for bandwidth extension, tune an output from the non-linear element in a second filter, provide the first voice signal and an output from the second filter to a comparator, the output of the second filter including a bandwidth extension, provide an output of the comparator, which is a difference between the first voice signal and the output of the second filter including the bandwidth extension, to a least means squared (LMS) calculator, provide an output of the LMS calculator to a filter coefficient adapter, in which coefficients in the second filter are adapted to optimize an LMS value, and provide an output from the filter coefficient adapter to the second filter; and a second portion to:

use the extracted filter coefficient parameters as a reference value to communicate, via a second base station, a second voice signal using a narrow band speech-compression algorithm.

7. The arrangement of claim 6, further comprising a fixed filter, a nonlinear element, a Multi-tap FIR filter, a FIR filter coefficient adapter, a comparator, and an arrangement for optimizing filter coefficients to minimize differences between original and created signals.

8. A mobile communication device comprising:

a housing;

a display;

a keypad;

a microphone;

an ear-piece;

an antenna;

a radio interface circuitry;

a codec circuitry;

a controller; and a memory, where the controller is to:

communicate, via a first base station, a first voice signal using a wide band speech-compression algorithm, filter the first voice signal to extract filter coefficient parameters with respect to the first voice signal, when, filtering the first voice signal, the controller being to:

filter, in a first filter, the first voice signal at a first transmission rate and extract a signal at a second transmission rate that is lower than the first transmission rate, provide the extracted signal to a non-linear element for bandwidth extension, tune an output from the non-linear element in a second filter, provide the first voice signal and an output from the second filter to a comparator, the output of the second filter including a bandwidth extension, provide an output of the comparator, which is a difference between the first voice signal and the output of the second filter including the bandwidth extension, to a least means squared (LMS) calculator, provide an output of the LMS calculator to a filter coefficient adapter, in which coefficients in the second filter are adapted to optimize an LMS value, and provide an output from the filter coefficient adapter to the second filter, and use the extracted filter coefficient parameters as a reference value to communicate, via a second base station, a second voice signal, using a narrow band speech-compression algorithm.

9. A non-transitory computer-readable medium comprising program code means for improving quality of a voice transmission when run on a computer, the computer program code comprising:

code for communicating, via a first base station, a first voice signal using a wide band speech-compression algorithm, code for filtering the first voice signal to extract filter coefficient parameters with respect to the first voice signal, the code for filtering the first voice signal including:

code for filtering, in a first filter, the first voice signal at a first transmission rate and extracting a signal at a second transmission rate that is lower than the first transmission rate, code for providing the extracted signal to a non-linear element for bandwidth extension, code for tuning an output from the non-linear element in a second filter, code for providing the first voice signal and an output from the second filter to a comparator, the output of the second filter including a bandwidth extension, code for providing an output of the comparator, which is a difference between the first voice signal and the output of the second filter including the bandwidth extension, to a least means squared (LMS) calculator, code for providing an output of the LMS calculator to a filter coefficient adapter, in which coefficients in the second filter are adapted to optimize an LMS value, and code for providing an output from the filter coefficient adapter to the second filter, and code for using the extracted filter coefficient parameters to communicate, via a second voice signal using a narrow band speech-compression algorithm.

10. A computer product comprising program code means stored on a non-transitory computer readable medium, when said program product is run on a computer, for performing improvement of quality of a voice transmission when run on a computer, the computer program comprising:

code for communicating, via a first base station, a first voice signal using a wide band speech-compression algorithm, code for filtering the first voice signal to extract filter coefficient parameters with respect to the first voice signal, the code for filtering the first voice signal including:

code for filtering, in a first filter, the first voice signal at a first transmission rate and extracting a signal at a second transmission rate that is lower than the first transmission rate, code for providing the extracted signal to a non-linear element for bandwidth extension, code for tuning an output from the non-linear element in a second filter, code for providing the first voice signal and an output from the second filter to a comparator, the output of the second filter including a bandwidth extension, code for providing an output of the comparator, which is a difference between the first voice signal and the output of the second filter including the bandwidth extension, to a least means squared (LMS) calculator, code for providing an output of the LMS calculator to a filter coefficient adapter, in which coefficients in the second filter are adapted to optimize an LMS value, and code for providing an output from the filter coefficient adapter to the second filter; and code for using the extracted filter coefficient parameters to communicate, via a second voice signal using a narrow band speech-compression algorithm.

* * * * *